US005494282A

United States Patent [19]

Pranio

[11] Patent Number: 5,494,282

[45] Date of Patent: Feb. 27, 1996

[54] GOLF CLUB PUTTER WITH YIPS PREVENTION AND ACCURATE LINE OF SIGHT

[76] Inventor: Thomas C. Pranio, 623 Lincoln Park East, Cranford, N.J. 07016

[21] Appl. No.: 409,736

[22] Filed: Mar. 23, 1995

Related U.S. Application Data

[63] Continuation-in-part of Ser. No. 301,845, Sep. 7, 1994, abandoned.

[51] Int. Cl.[6] ..... A63B 53/04

[52] U.S. Cl. ..... 273/80 C; 273/167 G; 273/167 A

[58] Field of Search ..... 273/167 G, 80 C, 273/164.1, 167 R, 167 A, 77 R, 174, 167 F, 169, 193 R, 194 R, 187.4

[56] References Cited

U.S. PATENT DOCUMENTS

| | | | |
|---|---|---|---|
| 1,703,199 | 2/1929 | McClure . | |
| 3,462,155 | 8/1969 | Pelz . | |
| 3,486,755 | 12/1969 | Hodge | 273/80 C |
| 3,758,115 | 9/1973 | Hoglund . | |
| 3,851,877 | 12/1974 | Giambazi | 273/167 G |
| 4,138,117 | 2/1979 | Dalton . | |
| 4,141,556 | 2/1979 | Paulin . | |
| 4,240,636 | 12/1980 | Swenson . | |
| 4,522,405 | 6/1985 | Clawges . | |
| 4,741,535 | 5/1988 | Leonhardt . | |
| 4,754,976 | 7/1988 | Pelz . | |
| 4,919,428 | 4/1990 | Perkins . | |
| 5,014,992 | 5/1991 | McCallister | 273/164.1 |
| 5,072,941 | 12/1991 | Klein . | |
| 5,209,474 | 5/1993 | Voyer . | |
| 5,224,702 | 7/1993 | Turner . | |
| 5,308,068 | 5/1994 | Strand . | |
| 5,344,141 | 9/1994 | Smith . | |

FOREIGN PATENT DOCUMENTS

| | | |
|---|---|---|
| 2081590 | 2/1982 | United Kingdom . |

*Primary Examiner*—Sebastiano Passaniti
*Attorney, Agent, or Firm*—Richard M. Goldberg

[57] ABSTRACT

A golf club putter includes a generally T-shaped club head having a front putting face, a bottom surface, a rear portion of the bottom surface being elevated with respect to a front portion of the bottom surface, and an upper surface having an upward inclination of 7 degrees from a front portion thereof to a rear portion thereof when the club head is addressing a golf ball; a shaft connected to the upper surface of the club head at a rear section thereof; substantially an entire portion of the shaft being oriented forwardly with respect to the club head at an angle of 9 degrees and oriented sidewards with respect to the club head at an angle of about 20 degrees; and the shaft having a length between 33 and 37 inches.

16 Claims, 4 Drawing Sheets

GOLF CLUB PUTTER WITH YIPS PREVENTION AND ACCURATE LINE OF SIGHT

REFERENCE TO RELATED APPLICATION

The present application is a Continuation-In-Part of U.S. patent application No. 08/301,845, filed Sep. 7, 1994 to the same applicant herein, and entitled GOLF CLUB PUTTER WITH YIPS PREVENTION now abandoned.

BACKGROUND OF THE INVENTION

The present invention relates generally to golf club putters, and more particularly, is directed to a golf club putter which prevents forward breaking of the wrists during a putting stroke, while providing an accurate line of sight.

During a putting stroke, breaking of the wrists in the forward direction, also known as the YIPS, is undesirable. In other words, the YIPS is the forward breaking of the wrists so that the club head moves ahead of the hands at the time of hitting the ball or immediately thereafter. If the wrists break in this manner during the putting stroke, much of the putting control is lost.

U.S. Pat. No. 5,209,474 to Voyer discloses a golf club putter that has an object of avoiding the YIPS. With this putter, the length of the shaft is increased by about one foot to 49 inches so that the medial stabilization portion of the shaft is received in the crook of the golfer's leading arm and the upper stabilization portion of the shaft contacts the outer surface of the upper portion of the leading arm. As a result, movement of the putter is restrained relative to the golfer's arms and wrists during putting so as to avoid the YIPS. In other words, by wedging the shaft in the crook of the leading arm and against the outer surface of the upper portion of the leading arm, there is a restriction in breaking of the wrists.

Because of this arrangement, the shaft of the putter is angled to the front by an angle Z which is between 2 degrees and 8 degrees with respect to the vertical, and which is preferably 5 degrees, that is, in order for the shaft to be received in the crook of the leading arm. Further, the shaft is angled to the side by an angle Y with respect to the vertical of at least 10 degrees, as with conventional putters.

However, this putter has various disadvantages.

First, there are various types of putting styles. For example, although forward breaking of the wrists, known as the YIPS, is undesirable, rearward breaking of the wrists is permissible. Thus, in one type of putting stroke, there is a rearward breaking of the wrists which results in a hand to head lag where the club head lags behind while the hands are moving forward. This type of putting stroke is therefore performed as a pulling putting stroke, in which the sensation is similar to that of dragging a spoon under water while the hand holding the spoon is above the water. The lag therefore has stored up power. However, this type of putting style cannot be used with the putter of Voyer since the shaft would move away from the leading arm, and would therefore not be situated in the crook thereof.

Another type of putting stroke provides a forward press where the putter head is pressed forward prior to starting the backswing of the putter, which provides a smooth transition in the stroke. This cannot be performed with the putter of Voyer since the upper stabilization portion of the shaft contacts the outer surface of the upper portion of the leading arm, thereby restricting such movement.

Second, there are various types of putting grips, such as the strong reverse overlap, weak overlap, split hand, palms opposed ten finger, double reverse overlap and forefinger down the shaft. Because of the requirement that the shaft be positioned in the crook of the leading arm, the putter of Voyer is limited to only certain grips.

Third, Voyer indicates that an object is to provide a golf putter which restrains bending of the wrists and leading arm during putting. This is because of the relationship of the shaft to the leading arm. However, because of this arrangement, the club head of Voyer will not move more than a few inches past the ball, after contacting the ball. This is because the upper part of the shaft against the outer portion of the upper arm restricts movement of the putter head past the hands. As a result, the golfer cannot take a natural stroke, and further cannot release the lagging arm at such time. With the putter of Voyer, to complete the stroke as with a natural swing, it is necessary for the golfer to lift his body up, thereby effecting an unnatural movement.

Fourth, the putter of Voyer is only operative if the angle of the putter is within the stated range. If the angle is increased, the medial stabilization portion of the shaft will not be received in the crook of the leading arm and the upper stabilization portion of the shaft will not contact the outer portion of the upper arm.

Fifth, it is impossible to connect the lower end of the shaft directly to the hosel in Voyer. This is because the putter head would have to be greater in length than the width thereof, which is not permitted by USGA Rules. For this reason, the lower end of the shaft is connected at a position spaced above the putter head.

Sixth, with the putter of Voyer, the left shoulder is raised, as shown in the figures of Voyer. This, however, does not result in a true pendulum stroke. Specifically, during the stroke, the putter head does not move along a straight line as viewed from above, but rather moves along an arcuate line. As a result, a true pendulum swing is not achieved. This is because Voyer is concerned with restraining movement of the stroke. Accordingly, the golfer must conform to the putter, rather than the putter conforming to the golfer's stroke. Further, when the left shoulder is raised, the eyes are not level so that proper alignment of the ball is not achieved.

Seventh, because the putter of Voyer has an increased length, which is necessary for it to be operative for its intended purpose, the weight of the putter will increase dramatically, which is undesirable. It has been suggested by experts that a putter should not weigh more than 20 ounces.

Another putter has been suggested in U.S. Pat. No. 5,344,141 to Smith in which the length of the shaft is that of a conventional putter and the forward inclination angle is preferably between about 0 degrees and 10 degrees, and most preferably about 1 degree. Because Smith teaches that 1 degree is the most desirable angle, there would be no YIPs prevention.

Further, with the Smith putter, the head is constructed in a barrel or cylindrical shape. As a result, substantially the entire bottom of the putter head is in contact with the ground surface at the beginning of the putting stroke, prior to taking the putter back. As a result, there will not be a smooth transition from the front of the club face to the back, so that there will be much friction and/or pressure from the ground surface, causing problems during the putting stroke. As a result, the bottom surface of the Smith putter head will skid when the ball is hit. Also, at the end of the stroke, the back portion of the cylindrical head will contact the ground. In addition, it becomes extremely difficult, if not impossible, to forward press the putter.

Finally, with the Smith putter, the shaft is attached either behind the barrel or in front of the center of gravity thereof. There is no teaching of attaching the shaft to a rear upper surface of the putter, at a position where the lower or bottom surface of the putter head does not contact the ground. Thus, when a person applies a downward pressure on the shaft of the Smith putter, the rear portion of the cylindrical putter head is in contact with the ground surface, causing problems with the putting stroke. In order to apply pressure only to the front portion of the putter head, Smith provides that the shaft is attached to the putter head in front of the center of gravity thereof.

U.S. Pat. No. 1,703,199 to McClure discloses a shaft angled forwardly with respect to the plane of the club face and connected toward the front of the putting head. The upper end of the shaft is in front of the hitting face by an amount equal to the radius of a golf ball, although the exact angle is not given.

U.S. Pat. No. 5,308,068 to Strand discloses a golf putter in which the shaft is angled forwardly by 10 degrees. However, the shaft is an extended shaft that rests on the forearm of the golfer while stroking and hitting the ball. Thus, this is similar to Voyer and has the same problems.

U.S. Pat. No. 5,224,702 to Turner discloses an offset hosel golf club in which the shaft is angled in the range of 0 degrees to 15 degrees. However, this is a wood, and the angulation is used to prevent slicing and hooking of the golf ball.

British Patent No. 2,081,590 to Thompson discloses a putter in which the shaft is angled forwardly about an angle A in the range of 15 degrees to 40 degrees, and preferably in the range of 18 degrees to 25 degrees. However, because this angulation is very large, it could not function to prevent the YIPs.

It is noted that, with the Thompson putter, the bottom surface of the putter head is angled upwardly at the rear thereof. See, also U.S. Pat. Nos. 4,754,976 to Pelz 5,072,941 to Klein.

In conventional putters where the shaft is not angled forwardly at all, the shaft is connected to the putter head at an angle of 90 degrees. As a result, there is a desired line of sight, and the putting stroke tends to be along a straight line from rear to front along such desired line of sight. However, it has been determined by the applicant herein that, when the shaft is angled forwardly of the putter head, it appears to the golfer that the putter head is angled inwardly to the left (for a right-handed golfer) and to the right (for a left-handed golfer) from the line of the desired putting stroke. As a result, there is a tendency for the golfer to compensate and thereby hit the ball to the right of the desired putting line for a right-handed golfer and to the left of the desired putting line for a left-handed golfer.

This problem is accentuated when the upper surface of the putting head slopes down to the rear to impart an aerodynamic appearance to the putter, in contrast to the case where the upper surface of the putter head has a surface which is horizontal, that is, parallel to the ground surface when the putter head addresses the ball. In such case, the right-handed golfer tends to hit the ball even further to the right of the desired putting line.

Other putters of varying configurations are described in U.S. Pat. Nos. 3,462,155 to Pelz; 3,758,115 to Hoglund; 4,138,117 to Dalton; 4,141,556 to Paulin; 4,240,636 to Swenson; 4,522,405 to Clawges; 4,741,535 to Leonhardt; and 4,919,428 to Perkins.

OBJECTS AND SUMMARY OF THE INVENTION

Accordingly, it is an object of the present invention to provide a golf club putter that overcomes the problems with the aforementioned prior art.

It is another object of the present invention to provide a golf club putter that prevents the YIPS.

It is still another object of the present invention to provide a golf club putter that is of a conventional length.

It is yet another object of the present invention to provide a golf club putter that can be used with all types of putting styles, thereby providing freedom of movement to the golfer.

It is a further object of the present invention to provide a golf club putter that can be used with all types of putting grips.

It is a still further object of the present invention to provide a golf club putter that permits the golfer to take a natural swing, even letting go of the putter with the lagging hand at the end of the stroke.

It is a yet further object of the present invention to provide a golf club putter in which the lower end of the shaft can be connected directly to the club head or hosel, while providing that the putter meets USGA regulations.

It is another object of the present invention to provide a golf club putter that ensures a true and straight pendulum stroke.

It is still another object of the present invention to provide a golf club putter in which the line of sight and the resultant swing is along the desired putting line, even when the shaft is angled forwardly of the putter head.

It is yet another object of the present invention to provide a golf club putter in which the upper surface of the putter head rises toward the rear thereof when the shaft is angled forwardly of the putter head.

It is a further object of the present invention in which the upper surface of the putter head rises toward the rear thereof at an angle of about 7 degrees when the shaft is angled forwardly of the putter head at about 9 degrees.

It is a still further object of the present invention in which the shaft is connected to the upper surface of the putter so as to form an angle therewith in the range of about 88 degrees to 90 degrees.

It is a still further object of the present invention to provide a golf club putter in which the shaft is in line with the leading arm and wrist of the golfer.

It is a yet further object of the present invention to provide a golf club putter in which only the front portion of the club head of the putter is in contact with the ground.

It is another object of the present invention to provide a golf club putter in which the weight of the golfer does not press on the golf club.

In accordance with an aspect of the present invention, a golf club putter includes a club head having a front putting face, a bottom surface, and a rear portion of the bottom surface is elevated with respect to a front portion of the bottom surface when the club head is addressing a golf ball; a shaft connected with the club head; substantially an entire portion of the shaft being oriented forwardly with respect to the club head at an angle between about 8 degrees and 10 degrees; and the shaft having a length less than or equal to about 37 inches.

Preferably, the shaft is oriented forwardly with respect to the club head at an angle of about 9 degrees, and is oriented sidewards with respect to the club head at an angle greater than or equal to 10 degrees, more preferably at an angle of about 20 degrees.

The shaft is connected to a rear section of the club head, which has a generally T-shaped configuration. The shaft has a length greater than about 33 inches.

In accordance with another aspect of the present invention, a golf club putter includes a club head having a front putting face, a bottom surface, and an upper surface having an upward inclination from a front portion thereof to a rear portion thereof when the club head is addressing a golf ball; and a shaft connected with the club head, the shaft being oriented forwardly with respect to the club head and the shaft having a length less than or equal to about 37 inches.

Substantially an entire portion of the shaft has an axis which is substantially perpendicular to the upper surface, and forms an angle in the range of about 88 degrees to 90 degrees with the upper surface. The shaft is fixed to the upper surface of the club head.

Substantially an entire portion of the shaft is oriented forwardly with respect to the club head at an angle between about 8 degrees and 10 degrees. Preferably, the shaft is oriented forwardly with respect to the club head at an angle of about 9 degrees, and the upper inclination of the surface is about 7 degrees.

In accordance with still another aspect of the present invention, a golf club putter includes a club head having a front putting face, a bottom surface, a rear portion of the bottom surface being elevated with respect to a front portion of the bottom surface, and an upper surface having an upward inclination from a front portion thereof to a rear portion thereof when the club head is addressing a golf ball; a shaft connected with the club head; substantially an entire portion of the shaft being oriented forwardly with respect to the club head at an angle between about 8 degrees and 10 degrees; the shaft having a length less than or equal to about 37 inches.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
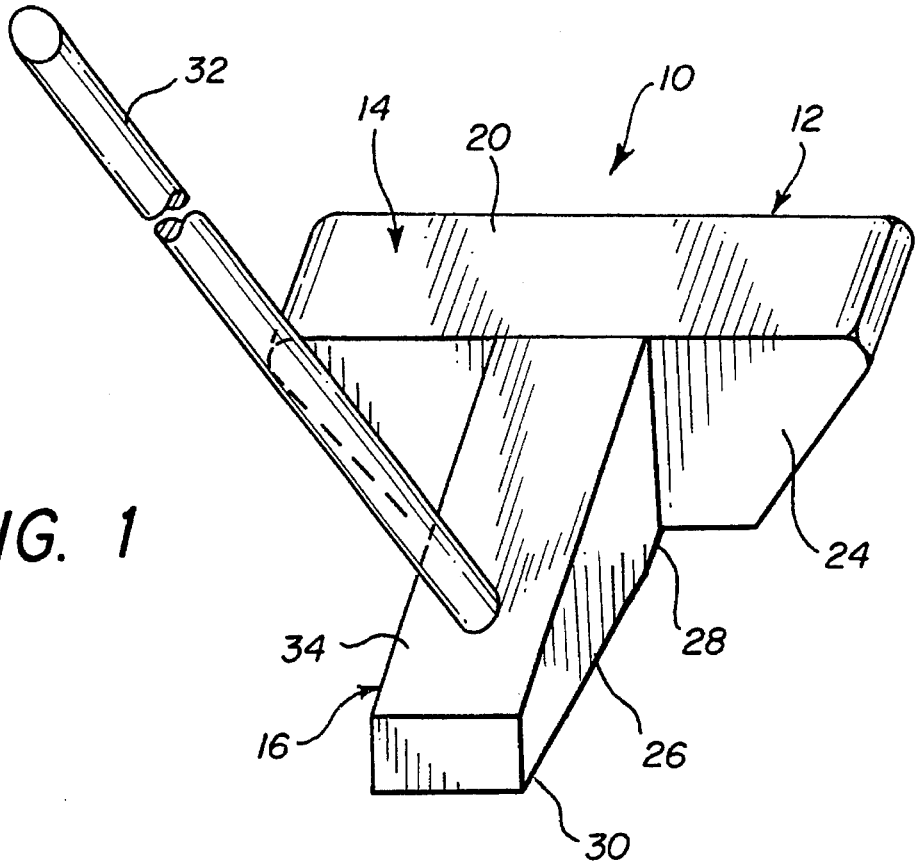
FIG. 1 is a perspective view of a golf club putter according to one embodiment of the present invention.
Figure 2:
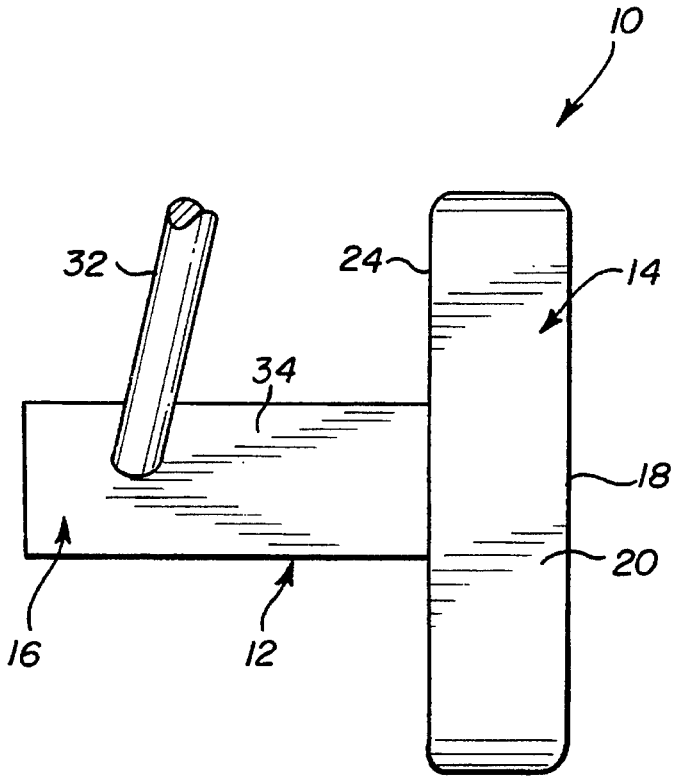
FIG. 2 is top plan view of the golf club putter of FIG. 1.

Referring to the drawings in detail, and initially to FIGS. 1–4, a golf club putter 10 according to a first embodiment of the present invention includes a club head 12 having a generally T-shaped configuration. Although club head 12 preferably has a T-shaped configuration which provides a natural heel to toe balance, club head 12 is not limited to a T-shaped configuration, and can have any other suitable configuration.

In the disclosed embodiment, club head 12 includes a front hitting section 14 and a rear shaft connecting section 16 connected at right angles to front hitting section 14 so as to form club head 12 into the aforementioned T-shaped configuration. In this regard, it is noted that rear shaft connecting section 16 is parallel to the eyes of the golfer and also functions as an aid in aligning a putt.

Figure 3:
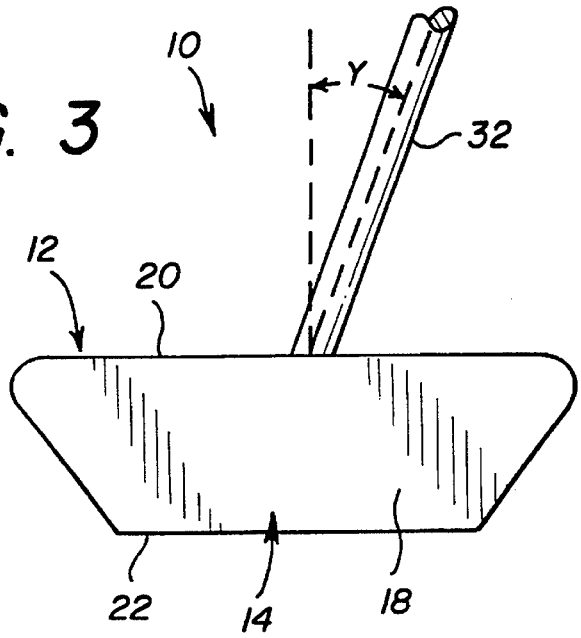
FIG. 3 is a front elevational view of the golf club putter of FIG. 1.

As shown best in FIGS. 1 and 3, front hitting section 14 has a generally trapezoidal configuration in plan view, so as to provide a substantially planar, trapezoidal front putting face 18. It will be appreciated, however, that any other suitable configuration can be provided, such as a rectangular configuration or the like. As examples of suitable dimensions that can be provided, top surface 20 of front hitting section 14 can have a side-to-side length of 3¼inches and a front-to-back width of ¾inch bottom surface 22 of front hitting section 14 can have a side-to-side length of 2 inches and a front-to-back width of ¾inch and front putting face 18 can have a height of 1 inch. The rear face 24 of front hitting section 14 is identical in shape and dimensions to front putting face 18, although the present invention is not limited thereto.

Figure 4:
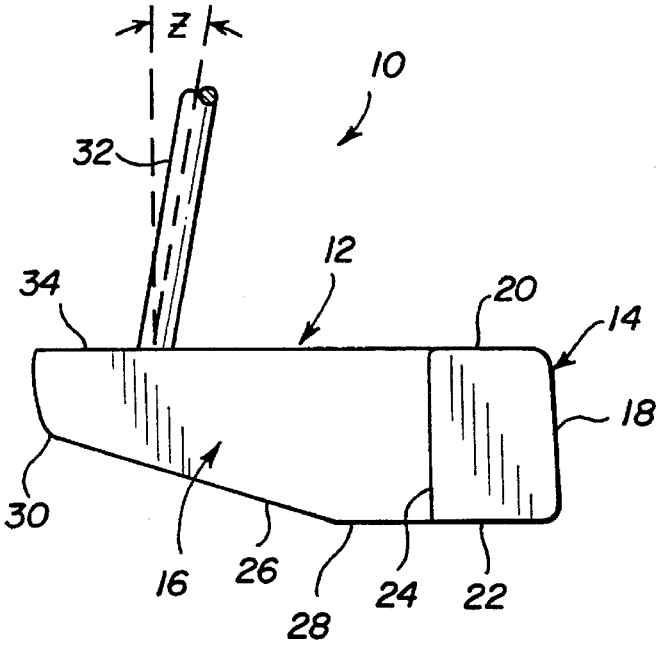
FIG. 4 is a side elevational view of the golf club putter of FIG. 1.

Rear shaft connecting section 16 is of a generally rectangular configuration, but with bottom surface 26 thereof tapering upwardly from the front end 28 to the rear end 30 thereof. As shown in FIG. 4, a portion of front end 28 of bottom surface 26 may be flat and in line with bottom surface 22 of front hitting section 14, although this is not necessary. Thus, rear end 30 of bottom surface 26 is elevated with respect to front end 28 of bottom surface 26 when golf club putter 10 is placed on the ground, the reasons for which will be better understood from the discussion which follows.

In a preferred embodiment, rear shaft connecting section 16 has a front-to-back length of 2¼inches, a height of 1 inch at the front end thereof which tapers to an elevated height of ½ inch at the rear end thereof due to the tapering of bottom surface 26, and a side-to-side width of ⅞inch.

Golf club putter 10 further includes a shaft 32 connected to the upper surface 34 of rear shaft connecting section 16. Shaft 32 is a conventional shaft and can be connected in any conventional manner to rear shaft connecting section 16. For example, shaft 32 can be welded in a hole in upper surface 34 of rear shaft connecting section 16, as shown. As an alternative, a hosel (not shown) can be provided for connecting shaft 32. Preferably, shaft 32 is connected at a position ¾inch from the rear end of rear shaft connecting section 16.

Shaft 32 has a length which is less than or equal to about 37 inches, as with shafts of conventional golf club putters, and preferably greater than about 33 inches. Therefore, unlike the aforementioned U.S. Pat. No. 5,209,474 to Voyer, shaft 32 will not reach to the crook of the leading arm of the golfer during a normal putting stance.

Shaft 32 is inclined to the side by an angle Y with respect to the vertical which is generally greater than 10 degrees as mandated by USGA Rules, is preferably in the range of about 15 to 22 degrees, and more preferably, is about 20 degrees, as best shown in FIG. 3.

Further, shaft 32 is connected to rear shaft connecting section 16 so as to have a forward orientation, that is, so as to be inclined relative to the vertical, with an angle Z greater than about 8 degrees, as best shown in FIG. 4. Preferably, such angle Z is in the range of about 8 to 10 degrees, and more preferably angle Z is equal to about 9 degrees. Because of such a construction, front putting face 18 preferably has a loft in the range of about 3 to 5 degrees, as shown in FIG. 4.

Further, shaft 32 can be connected directly to club head 12, and in fact, is connected to the upper surface of club head 12.

Because of the above construction, and particularly, because of the maximum length of the shaft, coupled with the front-to-back angle Z thereof, golf club putter 10 provides an improved putting stroke.

Specifically, with such construction, the hands of the golfer are maintained about 1½inches ahead of front putting face 18, and shaft 32 is always in line with the leading arm of the golfer during the entire putting stroke. As a result, the wrists of the golfer do not break during the putting stroke, so as to prevent the YIPS and thereby ensure that the golfer retains control during the entire putting stroke. It is noted that an angle Z less than about 8 degrees will not prevent the YIPS, that is, will result in breaking of the wrists during a putting stroke, and therefore, the angular range of U.S. Pat. No. 5,209,474 to Voyer would be insufficient to prevent the YIPS, absent the length of shaft 32 being dramatically increased, as disclosed therein. Stated another way, the putter of Voyer is only operative for its intended purpose if the angle of the putter is within the stated range in Voyer. Thus, if the angle is increased to the range of the present invention, the medial stabilization portion of the shaft of Voyer will not be received in the crook of the leading arm and the upper stabilization portion of the shaft will not contact the outer portion of the upper arm.

Further, because the hands of the golfer are maintained about 1½inches ahead of front putting face 18, the weight of the golfer is not pressing on the golf club. This means that the swing is more fluid, which further adds to the result that the wrists are not broken. With conventional putters, the person places weight on the shaft, which presses down on the putting head.

Still further, by utilizing a conventional length shaft which is equal to or less than about 37 inches, a normal stroke can be taken, whereby golf club putter 10 can be released so that club head 12 can travel more than a few inches past the ball, without providing any abnormal deformation of the body, that is, by using a natural swing. With such construction, the lagging hand can easily release after hitting the ball in a natural fluid motion.

Thus, with the present invention, a true pendulum stroke is attained, whereby club head 12 moves along a straight line, as viewed from above, and there is no restraint of movement. Further, during such putting stroke, the shoulders are level to achieve such true pendulum stroke and provide good sight for the stroke.

This means that all types of putting styles, including hand to head lag, and all types of putting grips can be used with the present invention, without any restriction thereof.

As discussed above, bottom surface 26 is inclined upwardly and rearwardly so that rear shaft connecting section 16 decreases in height from front end 28 to rear end 30 thereof. As a result, only bottom surface 22 of front hitting section 14 and possibly a portion of front end 28 of bottom surface 26 are in contact with the ground during the set-up of the putting stroke and during the actual putting stroke. This is important with the present construction in which the hands are about 1½inches ahead of front putting face 18, whereby only the front portion of club head 12 touches the ground, thereby ensuring a smoother stroke.

Figure 5:
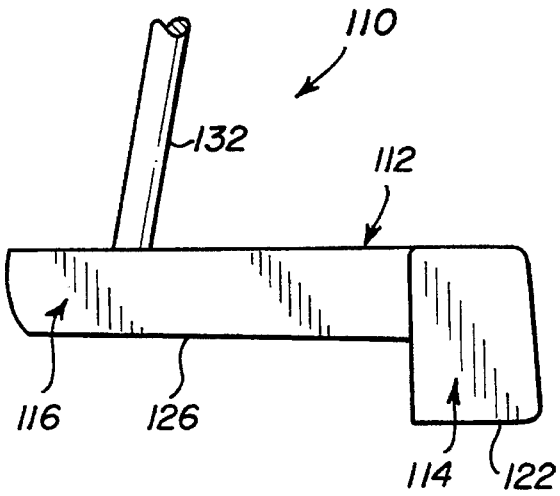
FIG. 5 is a side elevational view of a golf club putter according to another embodiment of the present invention.
Figure 7:
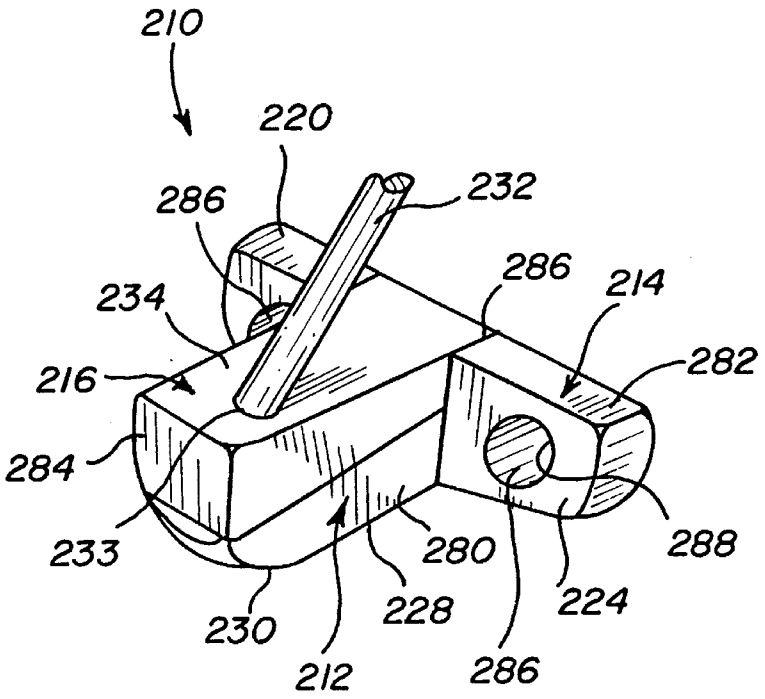
FIG. 7 is a rear perspective view of the golf club putter of FIG. 6.
Figure 6:
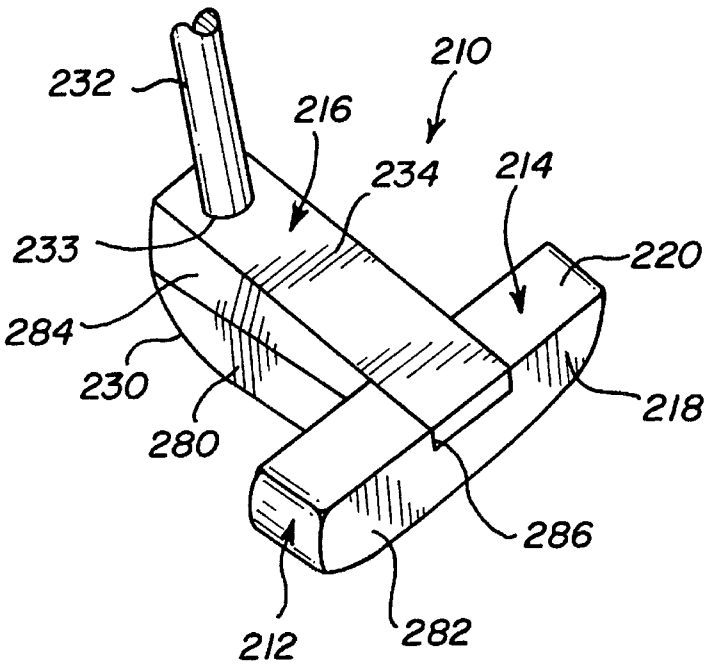
FIG. 6 is a front perspective view of a golf club putter according to another embodiment of the present invention.

Although bottom surface 26 is shown to have an incline, it will be appreciated that any construction in which the rear of the club head is elevated relative to the front of the club head can be used. In this regard, FIG. 5 shows another embodiment of a golf club putter 110 having a modified T-shaped club head 112 in which bottom surface 126 of rear shaft connecting section 116 is substantially parallel with bottom surface 122 of front hitting section 114, but is elevated with respect thereto. Of course, shaft 132 is still connected to rear shaft connecting section 116 in the same manner as in the first embodiment of FIGS. 1–4.

With the above putters 10 and 110, and in fact, with all putters having a forward inclination of the shaft, there is a slight problem during the putting stroke. Specifically, when the shaft is angled forwardly of the putter head, it appears that the putter head is angled inwardly to the left (for a right-handed golfer) from the line of the desired putting stroke and inwardly to the right (for a left-handed golfer). As a result, there is a tendency for the right-handed golfer to compensate and thereby hit the ball to the right of the desired putting line, and for the left-handed golfer to compensate and thereby hit the ball to the left of the desired putting line.

In order to correct this problem, reference is now made to FIGS. 6–11, wherein a golf club putter 210 according to another embodiment of the present invention will now be described, in which elements corresponding to those of golf club putter 10 are identified by the same reference numerals, augmented by 200. Putter 210 is shown for a left handed golfer.

Specifically, as shown, golf club putter 210 includes a club head 212 having a generally T-shaped configuration. Although club head 212 preferably has a T-shaped configuration which provides a natural heel to toe balance, club head 212 is not limited to a T-shaped configuration, and can have any other suitable configuration.

In the disclosed embodiment, club head 212 includes a front hitting section 214 and a rear shaft connecting section 216 connected at right angles to front hitting section 214 so as to form club head 212 into the aforementioned T-shaped configuration. In this regard, it is noted that rear shaft connecting section 216 is parallel to the eyes of the golfer and also functions as an aid in aligning a putt.

Figure 9:
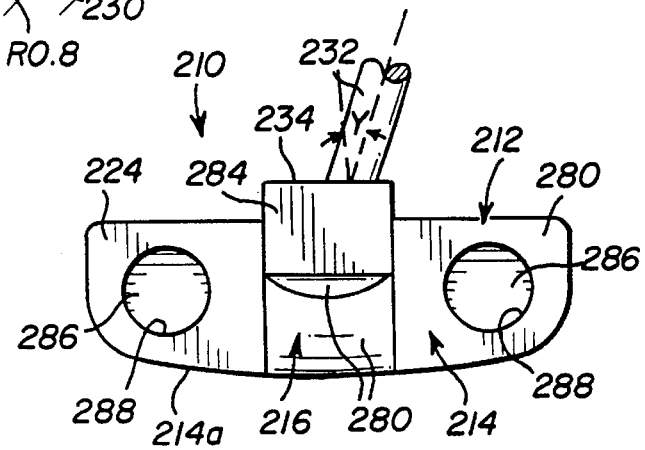
FIG. 9 is a rear elevational view of the golf club putter of FIG. 6.
Figure 10:
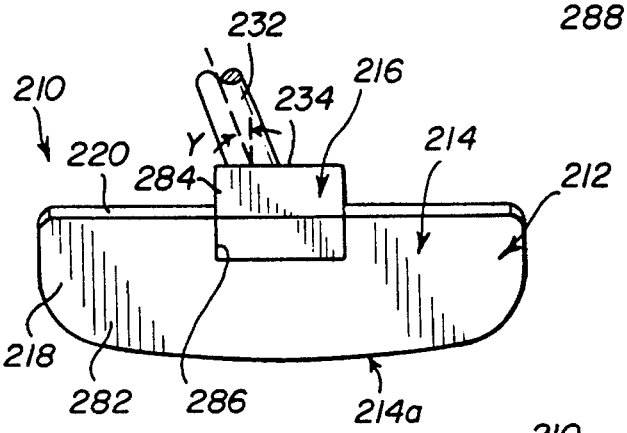
FIG. 10 is a front elevational view of the golf club putter of FIG. 6.

As shown best in FIGS. 9 and 10, front hitting section 214 has a generally rectangular configuration in plan view, with a slightly arcuate lower end **214*a* having a curvature defined by a circle with a radius of about 7 inches, so as to provide a substantially rectangular front putting face 218. It will be appreciated, however, that any other suitable configuration can be provided. As examples of suitable dimensions that can be provided, top surface 220 of front hitting section 14 can have a side-to-side length of 3.3 inches and a front-to-back width of 0.6 inch, with bottom surface 222 of front hitting section 214 having similar dimensions. Front putting face 218 can have a height at its center of 1 inch. The rear face 224 of front hitting section 214 is substantially identical in shape and dimensions to front putting face 218**, although the present invention is not limited thereto.

Figure 8:
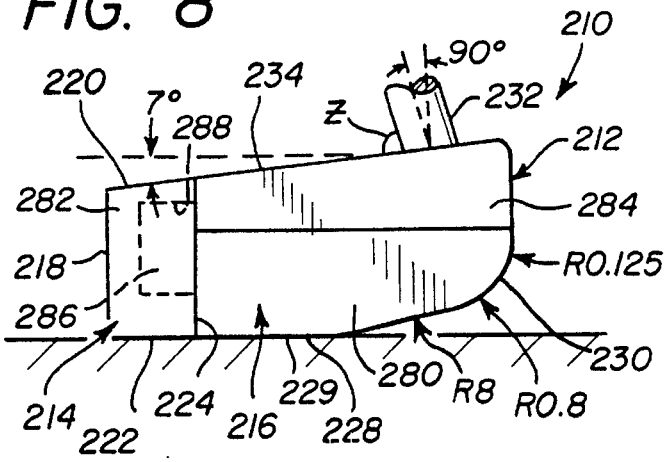
FIG. 8 is a side elevational view of the golf club putter of FIG. 6.
Figure 11:
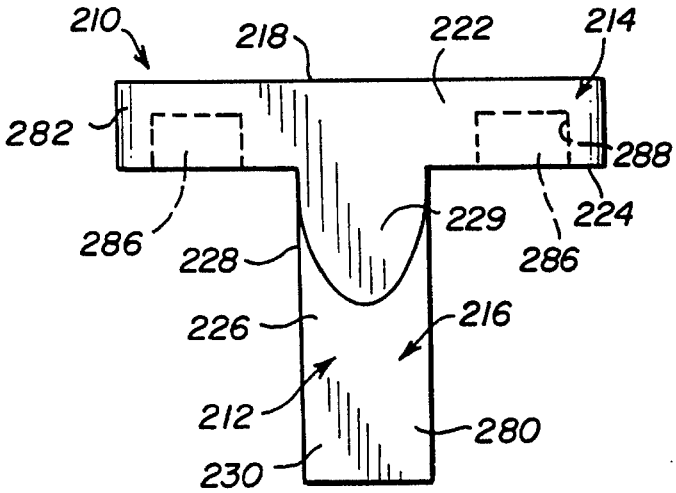
FIG. 11 is a bottom plan view of the golf club putter of FIG. 6.

Rear shaft connecting section 216 is of a generally rectangular configuration, but with bottom surface 226 thereof tapering upwardly from the front end 228 to the rear end 230 thereof. As shown in FIGS. 8 and 11, a portion 229 of front end 228 of bottom surface 226 is flat and in line and at the same level with bottom surface 222 of front hitting section 214. Portion 229 has a configuration of a half oval, although it is not so limited. Thus, rear end 230 of bottom surface 226 is elevated with respect to front end 228 of bottom surface 226 when golf club putter 210 is placed on the ground, the reasons for which will be better understood from the discussion which follows. As one example, bottom surface can curve upwardly from portion 229 along a circle with a radius of 8 inches (R7), followed by a circle with a radius of 0.8 inch (R0.8), followed by a circle with a radius of 0.125 inch (R0.125), as shown in FIG. 8.

In a preferred embodiment, rear shaft connecting section 216 has a front-to-back length of 2.17 inches, and a side-to-side width of 0.874 inch.

Golf club putter 210 further includes a shaft 232 connected to upper surface 234 of rear shaft connecting section 216. Shaft 232 is a conventional shaft and can be connected in any conventional manner to rear shaft connecting section 216. For example, shaft 232 can be welded in a hole 233 in upper surface 234 of rear shaft connecting section 216, as shown. As an alternative, a hosel (not shown) can be provided for connecting shaft 232. Preferably, shaft 232 is connected at a position such that the axis thereof is 0.55 inch from the rear edge of the top surface of rear shaft connecting section 216 and which is offset slightly to the longer edge of rear shaft connecting section 216 that is closest to the golfer.

Shaft 232 has a length which is less than or equal to about 37 inches, as with shafts of conventional golf club putters, and preferably greater than about 33 inches. Therefore, unlike the aforementioned U.S. Pat. No. 5,209,474 to Voyer, shaft 232 will not reach to the crook of the leading arm of the golfer during a normal putting stance.

Shaft 232 is inclined to the side by an angle Y from the vertical, which is generally greater than 10 degrees as mandated by USGA Rules, is preferably in the range of about 15 to 22 degrees, and more preferably, is about 20 degrees, as best shown in FIGS. 9 and 10.

Further, shaft 232 is connected to the upper surface of rear shaft connecting section 216 so as to have a forward orientation Z, that is, so as to be inclined relative to the vertical with an angle greater than about 8 degrees, as best shown in FIG. 8. Preferably, such angle is in the range of about 8 to 10 degrees, and more preferably the angle is equal to about 9 degrees. If the angle is outside of this range, effective YIPs prevention is not obtained. In such configuration, there is no loft to front putting face 218, although a loft can be provided as in the first embodiment.

Because of the above construction, and particularly, because of the maximum length of the shaft, coupled with the front-to-back angle of 8 degrees to 10 degrees thereof, golf club putter 210 provides an improved putting stroke.

Specifically, as with the first embodiment of FIG. 1–4, the construction of FIGS. 6–11 provides that the hands of the golfer are maintained about 1½inches ahead of front putting face 218, and shaft 232 is always in line with the leading arm of the golfer during the entire putting stroke. As a result, the wrists of the golfer do not break during the putting stroke, so as to prevent the YIPS and thereby ensure that the golfer retains control during the entire putting stroke. It is noted that a forward angle of shaft 232 less than about 8 degrees will not prevent the YIPS, that is, will result in breaking of the wrists during a putting stroke, and therefore, the angular range of U.S. Pat. No. 5,209,474 to Voyer would be insufficient to prevent the YIPS, absent the length of shaft 232 being dramatically increased, as disclosed therein. Stated another way, the putter of Voyer is only operative for its intended purpose if the angle of the putter is within the stated range in Voyer. Thus, if the angle is increased to the range of the present invention, the medial stabilization portion of the shaft of Voyer will not be received in the crook of the leading arm and the upper stabilization portion of the shaft will not contact the outer portion of the upper arm. In like manner, if the angle is greater than about 10 degrees, effective YIPs prevention will not be obtained.

Further, because the hands of the golfer are maintained about 1½inches ahead of front putting face 218, the weight of the golfer is not pressing on the golf club. This means that the swing is more fluid, which further adds to the result that the wrists are not broken. With conventional putters, the person places weight on the shaft, which presses down on the putting head.

Still further, by utilizing a conventional length shaft which is equal to or less than about 37 inches, a normal stroke can be taken, whereby golf club putter 210 can be released so that club head 212 can travel more than a few inches past the ball, without providing any abnormal deformation of the body, that is, by using a natural swing. With such construction, the lagging hand can easily release after hitting the ball in a natural fluid motion.

Thus, with the present invention, a true pendulum stroke is attained, whereby club head 212 moves along a straight line, as viewed from above, and there is no restraint of movement. Further, during such putting stroke, the shoulders are level to achieve such true pendulum stroke and provide good sight for the stroke.

This means that all types of putting styles, including hand to head lag, and all types of putting grips can be used with the present invention, without any restriction thereof.

As discussed above, bottom surface 226 is inclined upwardly and rearwardly. As a result, only bottom surface 222 of front hitting section 214 and portion 229 of front end 228 of bottom surface 226 are in contact with the ground during the set-up of the putting stroke and during the actual putting stroke. This is important with the present construction in which the hands are about 1½inches ahead of front putting face 218, whereby only the front portion of club head 212 touches the ground, thereby ensuring a smoother stroke. This is particularly important in the present invention where the shaft is connected to the rear of the club head, so that even if there is any weight on the putter, it will be applied to the front of the club head because the rear is raised off of the ground, as shown in FIG. 8.

In accordance with an important aspect of the present invention, the entire upper surface of club head 212 is angled upwardly from the front to the rear thereof, such that shaft 232 forms an angle with upper surface 234 at an angle in the range of about 85 degrees to 90 degrees, and preferably in the range of about 88 degrees to 90 degrees, as shown best in FIG. 8. This range and equivalents thereof are defined herein as being "substantially perpendicular". For example, an equivalent could cover an angle of 91 degrees. In the most preferred embodiment, the upward angulation of the upper surface of club head 212 with respect to horizontal or ground surface is 7 degrees, as shown in FIG. 8, when club head 212 is addressing the golf ball, and the forward angulation of shaft 232 with respect to the vertical is 9 degrees. As a result, the angle of shaft 232 with upper surface 234 is 88 degrees.

By providing the upward angulation of the upper surface of club head 212 from the front to the rear thereof, the problems of the club head appearing to be angled inwardly to the left for a right-handed golfer and inwardly to the right for a left-handed golfer, from the line of the desired putting stroke, as occurs when there is no upward slope to the upper surface of the club head and where there is a forward inclination of the shaft, is avoided. As a result, there is no tendency for the right-handed golfer to compensate and thereby hit the ball to the right of the desired putting line and for the left-handed golfer to compensate and thereby hit the ball to the left of the desired putting line.

In this regard, it will be appreciated that the substantially perpendicular relation of shaft 232 to club head 212 avoids the problems of viewing an angulation in the club head 212 that occurs with the prior art and with the first embodiment of the present invention, when the shaft is angled forwardly of the club head. In fact, the known prior art has been completely contrary to the present invention by providing no inclination or by even providing an opposite inclination of the upper surface of the club head, that is, downwardly from the front to the rear thereof in order to obtain an aerodynamic appearance, as shown for example, in Voyer.

Thus, with the embodiment of FIGS. 6–11, the line of sight and the resultant swing is along the desired putting line, even when the shaft is angled forwardly of the putter head.

Although an upward inclination of 7 degrees is shown, such inclination will change depending upon the forward angle of inclination Z of shaft 232, in order to obtain the substantially perpendicular relation and so that the line of sight and the resultant swing is along the desired putting line, even when the shaft is angled forwardly of the putter head.

Further, although the upward inclination of upper surface of club head 212 is shown to be along the entire length of club head 212, and in fact, along the upper surface of both front hitting section 214 and a rear shaft connecting section 216, it is not so limited. It is sufficient that the upward inclination be along so much of the upper surface of club head 212 to provide that the line of sight and the resultant swing is along the desired putting line, even when the shaft is angled forwardly of the putter head. Preferably, to obtain the most benefit, this should be along the entire upper surface of club head 212. For example, the inclination may stop at the connection of shaft 232 to club head 212, and thereafter, level off horizontally or even slope downwardly toward the rear from such point of connection.

It is noted that club head 212 is constructed from different materials. Specifically, a bottom portion 280 of rear shaft connecting section 216 and the major portion 282 of front hitting section 214 are formed as an integral piece of aluminum. The top portion 284 of rear shaft connecting section 216 is formed of brass, with such top portion 284 extending to the front putting face 218 of club head 212, and thereby extending within a cut-out recess 286 in the major portion 282 of front hitting section 214. The upper surface of top portion 284 is angled upwardly and rearwardly at the aforementioned 7 degrees from front putting face 218 to the rear of club head 212, and the upper surface of top portion 284 at the front end thereof is coplanar with the upper surface of major portion 282 of front hitting section 214 so as to provide the upward and rearward inclination of 7 degrees along the entire upper surface of club head 212.

In addition, cylindrical brass inserts 286 are mounted in cut-away recesses 288 at the rear face 224 of front hitting section 214. Preferably, inserts 286 have a diameter of 0.610 inch.

The use of brass for top portion 284 and inserts 286 results in a reduction in weight of putter head 212 so as to obtain desired weight and balancing characteristics thereof.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A golf club putter comprising:

a club head having:
- a front putting face,
- a bottom surface, and
- an upper surface having an upward inclination from a front portion thereof to a rear portion thereof when said club head is addressing a golf ball; and a shaft connected with said club head, said shaft being oriented forwardly with respect to said club head and said shaft having a length less than or equal to about 37 inches.

2. A golf club putter according to claim 1, wherein substantially an entire portion of said shaft has an axis which is substantially perpendicular to said upper surface.

3. A golf club putter according to claim 1, wherein substantially an entire portion of said shaft has an axis which forms an angle in the range of about 88 degrees to 90 degrees with said upper surface.

4. A golf club putter according to claim 1, wherein said shaft is fixed to the upper surface of said club head.

5. A golf club putter according to claim 1, wherein said shaft is oriented sidewards with respect to said club head at an angle greater than or equal to 10 degrees.

6. A golf club putter according to claim 5, wherein said shaft is oriented sidewards with respect to said club head at an angle of about 20 degrees.

7. A golf club putter according to claim 1, wherein said shaft is connected to a rear section of said club head.

8. A golf club putter according to claim 1, wherein said shaft has a length greater than about 33 inches.

9. A golf club putter according to claim 1, wherein substantially an entire portion of said shaft is oriented forwardly with respect to said club head at an angle between about 8 degrees and 10 degrees.

10. A golf club putter according to claim 9, wherein said shaft is oriented forwardly with respect to said club head at an angle of about 9 degrees, and said upper inclination of said surface is about 7 degrees.

11. A golf club putter comprising:

a club head having:
- a front putting face,
- a bottom surface, a rear portion of said bottom surface being elevated with respect to a front portion of said bottom surface, and
- an upper surface having an upward inclination from a front portion thereof to a rear portion thereof when said club head is addressing a golf ball;

a shaft connected with said club head; substantially an entire portion of said shaft being oriented forwardly with respect to said club head at an angle between about 8 degrees and 10 degrees;

said shaft having a length less than or equal to about 37 inches.

12. A golf club putter according to claim 11, wherein substantially an entire portion of said shaft has an axis which is substantially perpendicular to said upper surface.

13. A golf club putter according to claim 11, wherein substantially an entire portion of said shaft has an axis which forms an angle in the range of about 88 degrees to 90 degrees with said upper surface.

14. A golf club putter according to claim 11, wherein said shaft is fixed to the upper surface of said club head at a rear section thereof.

15. A golf club putter according to claim 11, wherein said shaft is oriented forwardly with respect to said club head at an angle of about 9 degrees, and said upper inclination of said surface is about 7 degrees.

16. A golf club putter according to claim 11, wherein said shaft is oriented sidewards with respect to said club head at an angle greater than or equal to 10 degrees.

* * * * *